US010959500B1

(12) United States Patent
Holbrook et al.

(10) Patent No.: US 10,959,500 B1
(45) Date of Patent: Mar. 30, 2021

(54) UMBRELLA

(71) Applicants: Richard Holbrook, Pasadena, CA (US); Darren Mark, Pasadena, CA (US)

(72) Inventors: Richard Holbrook, Pasadena, CA (US); Darren Mark, Pasadena, CA (US)

( * ) Notice: Subject to any disclaimer, the term of this patent is extended or adjusted under 35 U.S.C. 154(b) by 0 days.

(21) Appl. No.: 16/800,471

(22) Filed: Feb. 25, 2020

(51) Int. Cl.
*A45B 25/10* (2006.01)
*A45B 25/14* (2006.01)
*A45B 11/00* (2006.01)
*A45B 23/00* (2006.01)

(52) U.S. Cl.
CPC ..... *A45B 25/10* (2013.01); *A45B 11/00* (2013.01); *A45B 23/00* (2013.01); *A45B 2011/005* (2013.01); *A45B 2023/0012* (2013.01); *A45B 2023/0037* (2013.01); *A45B 2023/0068* (2013.01); *A45B 2023/0081* (2013.01)

(58) Field of Classification Search
CPC . A45B 25/10; A45B 25/14; A45B 2023/0037; A45B 2019/007; E04H 15/28
See application file for complete search history.

(56) References Cited

U.S. PATENT DOCUMENTS 2,948,287 A * 8/1960 Rupert ..... E04H 15/28 135/126
2,953,145 A * 9/1960 Moss ..... E04H 15/28 135/98
3,054,413 A * 9/1962 Eshelman ..... E04H 15/28 135/123
4,567,907 A 2/1986 Dubinsky
4,736,761 A * 4/1988 Warfield ..... A45B 25/02 135/15.1
4,966,178 A * 10/1990 Eichhorn ..... E04H 15/28 135/123
5,116,258 A * 5/1992 Vennik ..... A45B 23/00 135/20.3
5,293,890 A * 3/1994 Park ..... E04H 15/322 135/156
6,325,084 B1 12/2001 Cohen
D475,524 S 6/2003 Clarke
(Continued)

FOREIGN PATENT DOCUMENTS

EP 1654952 5/2006
EP 2845509 3/2015
(Continued)

*Primary Examiner* — Noah Chandler Hawk
(74) *Attorney, Agent, or Firm* — Todd R. Miller

(57) ABSTRACT

A novel umbrella includes a support post, a housing supported thereby, spokes pivotally disposed about the housing, a canopy, and an actuator. The housing has a top hub and a bottom hub. The actuator slides the hubs together to pivot the spokes away from the housing, whereby the umbrella moves from a closed position to an open position. Rollers are retained within the top hub, and each spoke has a spoke cam attached to one end. The spokes pivot away from the housing by having a roller surface of each spoke cam slide along each respective roller. The actuator may include a beam pivotally disposed about the support post, a strut pivotally disposed about the support post and coupled to the beam, a car slide slideably disposed within the beam, and a cable coupled to the strut and the housing.

11 Claims, 16 Drawing Sheets

(56) References Cited

U.S. PATENT DOCUMENTS

| | | | | |
|---|---|---|---|---|
| D503,272 | S | 3/2005 | Machin | |
| 6,923,193 | B2 * | 8/2005 | Chen | A45B 23/00 135/20.1 |
| D513,118 | S | 12/2005 | Browne | |
| D526,476 | S | 8/2006 | Browne | |
| 7,178,535 | B2 | 2/2007 | Eder | |
| 7,318,444 | B2 | 1/2008 | Clarke | |
| D609,453 | S | 2/2010 | Liu | |
| 7,900,643 | B2 | 3/2011 | Ma | |
| 8,061,375 | B2 | 11/2011 | Ma | |
| 8,166,986 | B2 | 5/2012 | Ma | |
| 9,574,366 | B2 * | 2/2017 | Choi | E04H 15/48 |
| D813,524 | S | 3/2018 | Ma | |
| 10,412,905 | B2 * | 9/2019 | Kish | A01G 13/10 |
| 2006/0102215 | A1 | 5/2006 | Eder | |
| 2007/0051399 | A1 * | 3/2007 | Jung | E04H 15/48 135/135 |
| 2007/0062565 | A1 | 3/2007 | Clarke | |

FOREIGN PATENT DOCUMENTS

| | | |
|---|---|---|
| EP | 2223624 | 7/2015 |
| EP | 2774503 | 4/2017 |

* cited by examiner

UMBRELLA

BACKGROUND

The present disclosure relates generally to a shade device and particularly to a novel umbrella with a simplified structure that creates a clean, elegant profile with reduced component count and increased wind resistance.

SUMMARY

One exemplary embodiment of the disclosed subject matter is an umbrella comprising a support post, a housing supported by the post, spokes pivotally disposed about the housing, a canopy disposed about the spokes, and an actuator. The clamshell-style housing has a top hub and a bottom hub. The actuator moves the hubs together to pivot the spokes away from the housing, whereby the umbrella moves from a closed position to an open position.

The top hub and bottom hub are preferably slideably engageable with one another, wherein the first end of each spoke is pivotally disposed between the hubs. In particular, the top hub may include a tubular prong extending downward therefrom, with the bottom hub having a prong receptacle extending upward therefrom, wherein the prong receptacle is adapted to receive the tubular prong. In operation, the tubular prong slides within the prong receptacle as the umbrella moves from the closed position to the open position and vice versa.

The umbrella also preferably includes rollers retained within the top hub, wherein each spoke has a spoke cam having a roller surface. The spokes pivot away from the housing by having the roller surface of each spoke cam slide along each respective roller. In such an arrangement, the bottom hub has one or more cam channels for respectively receiving each spoke cam. A cover plate has one or more rollers channels for respectively receiving the one or more rollers.

The actuator may include a beam pivotally disposed about the support post, a strut pivotally disposed about the support post and coupled to the beam, a car slide slideably disposed within the beam, and a cable coupled to the strut and the housing. The car slide moves toward the top end of the support post when the umbrella goes from the closed position to the open position, wherein movement of the car slide pivots the beam and the strut away from the support post for tensioning the cable. Doing so slides the top hub and bottom hub closer to one another causing the spokes to pivot away from the housing. With this arrangement, the umbrella preferably includes a first pulley disposed within a top cavity of the top hub, wherein the cable runs from one end of the strut through the beam and into the top cavity of the top hub, around the first pulley, through the tubular prong, and stops at an anchor point disposed about the bottom hub. This cantilever-style arrangement advantageously creates a single-motion canopy lift.

Instead of a cantilever-style arrangement, the actuator may have a crank operated worm drive mechanism to raise and lower the canopy. In particular, the umbrella may include a threaded receptacle contained within the housing, wherein the actuator includes a threaded rod adapted to engage the threaded receptacle. A rotatable crank is coupled to the threaded rod. Rotation of the crank causes the threaded rod to screw through the threaded receptacle, whereby the hubs slide closer to one another causing the spokes to pivot away from the housing to open the umbrella.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

Figure 1:
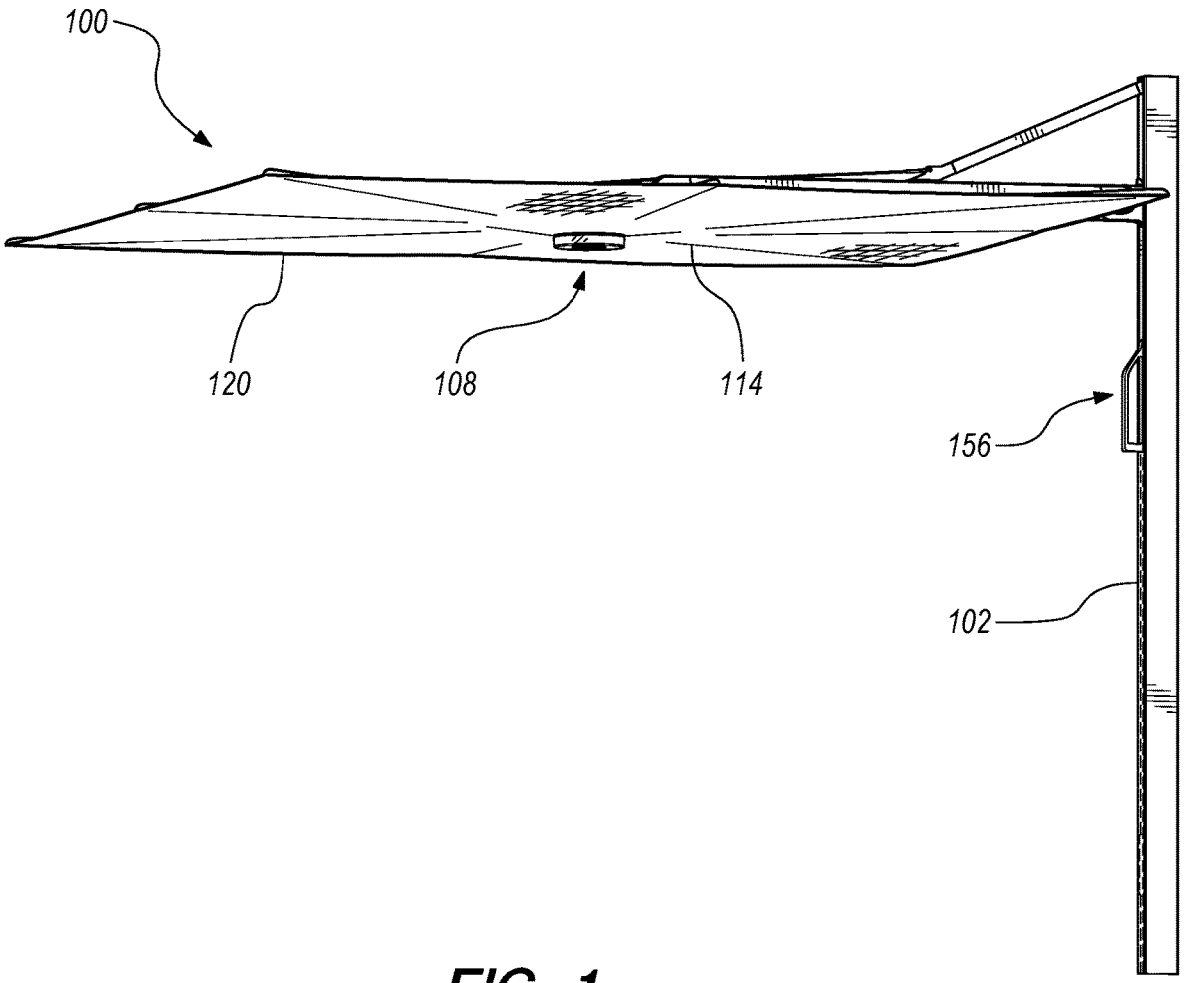
FIG. 1 is a perspective view of one embodiment of the umbrella disclosed herein.

Shade devices such as umbrellas are often necessary for relaxing at the pool or beach without concern of too much sun. A conventional umbrella often has a complex framework of tubes and connectors that make the umbrella look cluttered and mechanical. Such tubes and connectors are typically vulnerable to corrosion and require frequent cleaning. Moreover, the standard umbrella usually has a rigid aluminum frame vulnerable to bending and breaking in high winds. This conventional umbrella with its multiple tubes and connectors translates to a high component count, resulting in an extensive inventory and high operational cost to offer a variety of sizes. Finally, it is usually necessary to change out many components to offer different size canopies.

Accordingly, a novel umbrella is desired with a simplified structure that creates a clean, elegant profile with dramatically reduced component count, increased wind resistance, and decreased number of components to change out to offer different size canopies.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

FIGS. 1-6 illustrates a perspective view of one embodiment of the novel umbrella disclosed herein. As seen in these figures, umbrella 100 includes a support post 102 having a top end 104 and an opposing bottom end 106. A clamshell-style housing 108 is supported by post 102. A canopy 120 is disposed about a plurality of spokes 114.

Figure 2A:
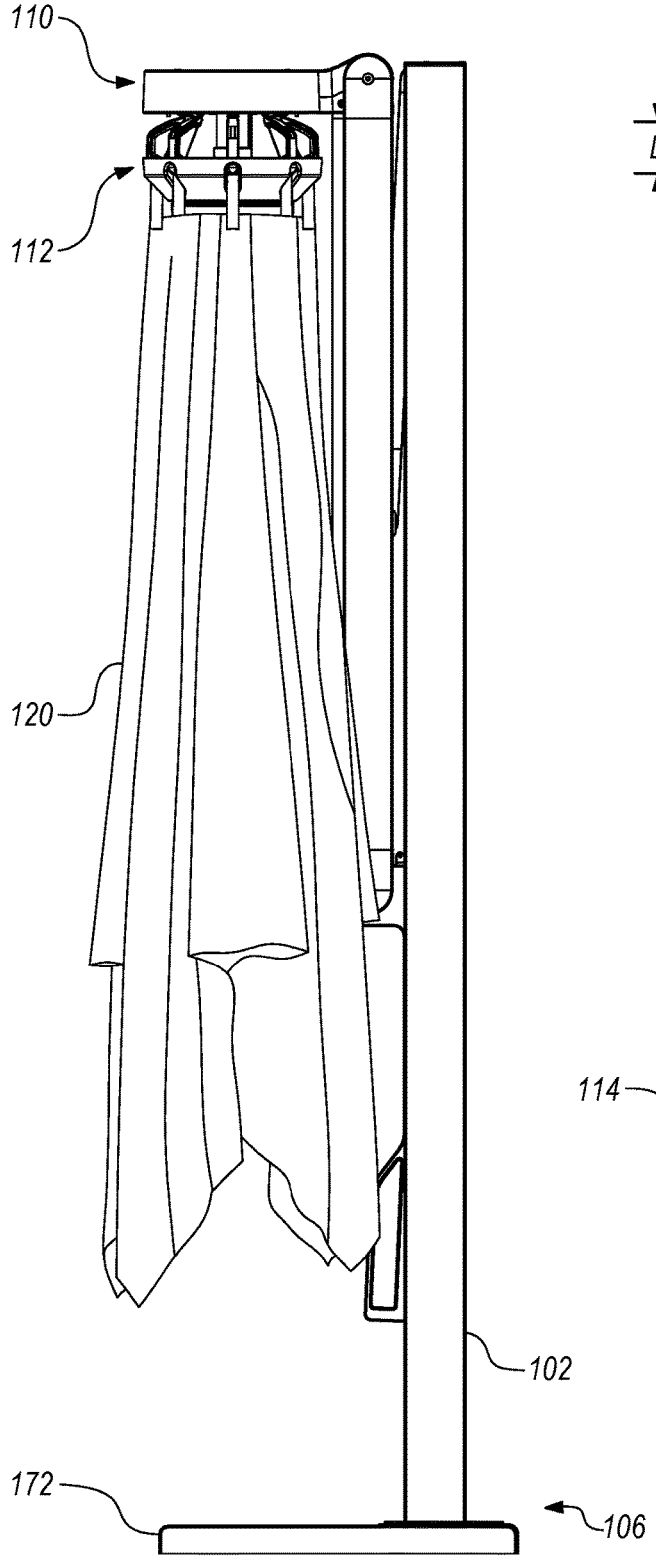
FIG. 2A is a side view of the umbrella seen in FIG. 1, with optional base, showing the umbrella in the closed position.
Figure 2B:
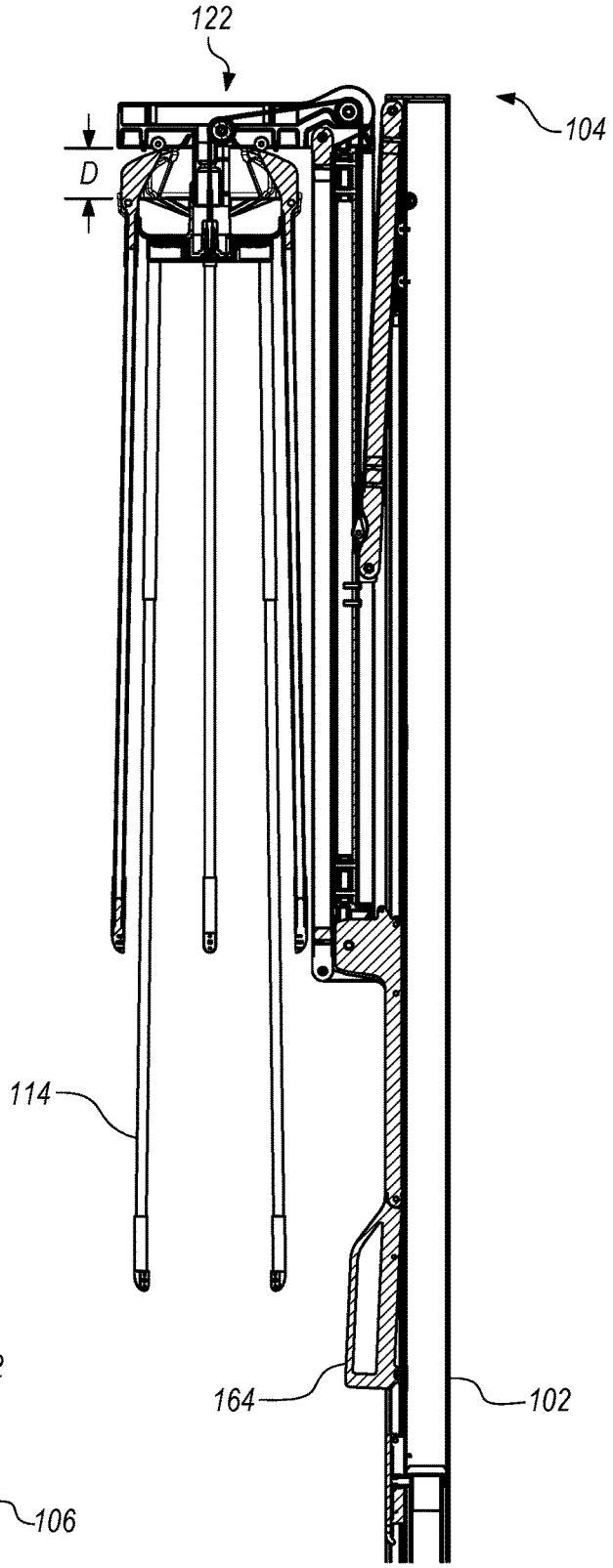
FIG. 2B is a cross-sectional view of part of the umbrella in FIG. 2A, but showing the umbrella without its canopy.

As seen in FIG. 1, the spokes 114 radially extend away from the housing 108 when the umbrella 100 is in its fully opened position 124. Compared to FIG. 2A, which shows the umbrella 100 in its closed position 122, spokes 114 have gone from being substantially parallel to the post 102 in the closed position 122 to substantially orthogonal to the post 102 in the open position 124. FIG. 2A also shows an optional base 172 disposed about the bottom end 106 of post 102.

Figure 6:
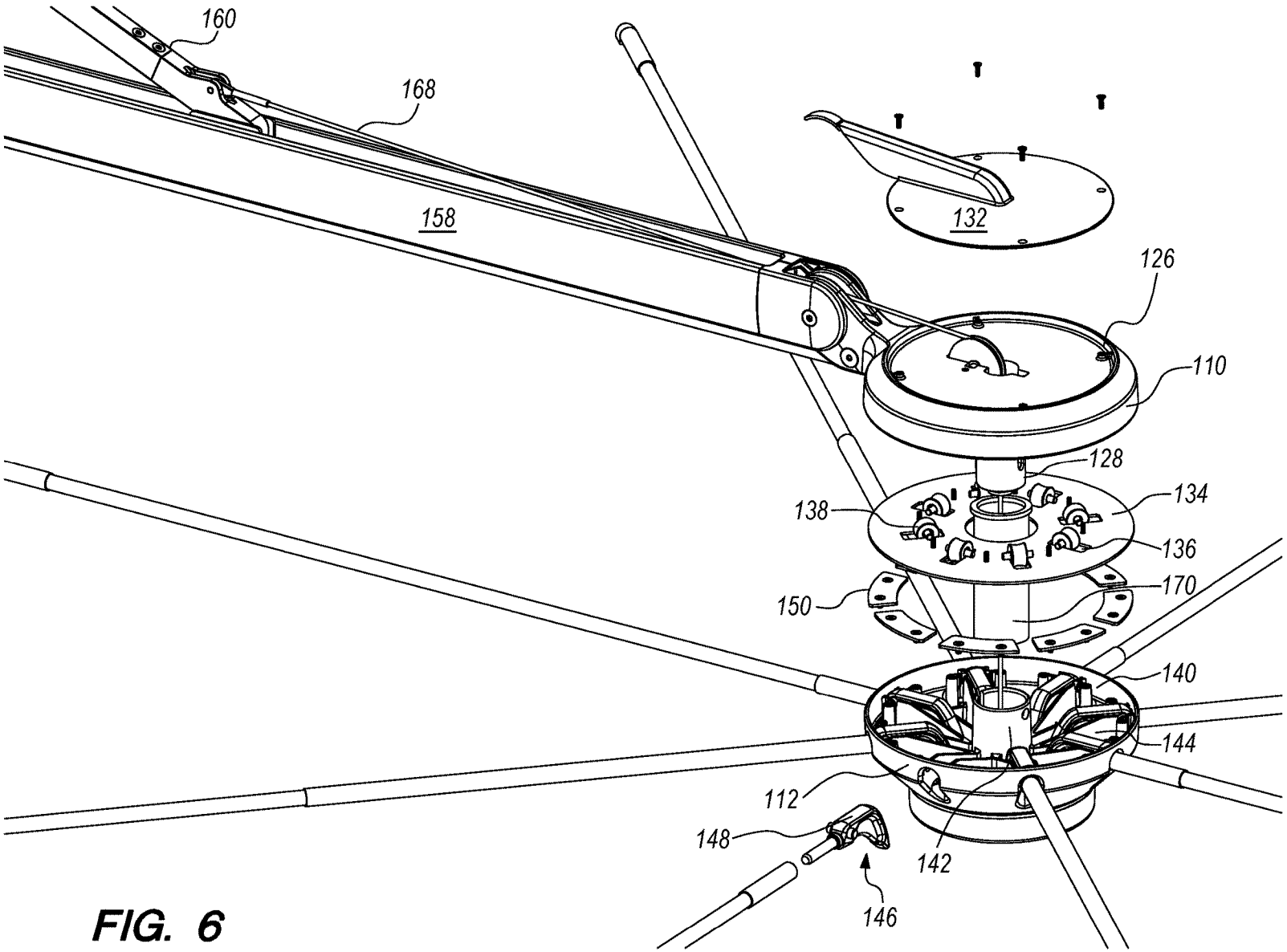
FIG. 6 is an exploded view of the housing with its spokes extending radially therefrom when in the open position, wherein the beam and strut may be seen supporting the housing, and the cable going from the strut, through the beam, and into the top hub.
Figure 7:
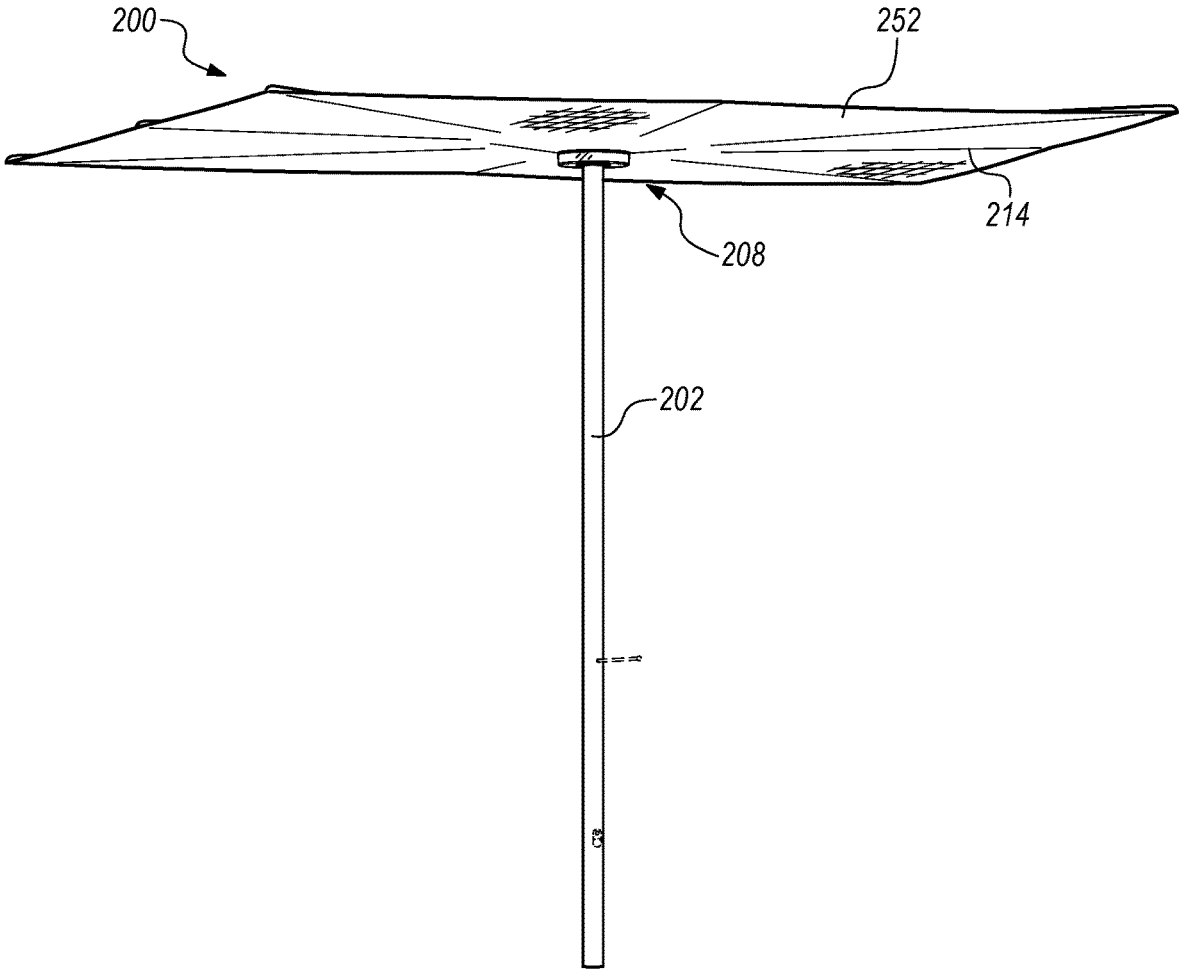
FIG. 7 is a perspective view of another embodiment of the umbrella disclosed herein.

The details of the housing 108 may be best seen with reference to FIG. 6. There, housing 108 is illustrated with a top hub 110 and an opposing bottom hub 112, each of which is preferably made of die cast aluminum. Top hub 110 has a top cavity 126 and an opposing bottom cavity 172. Top hub 110 has a tubular prong 128 extending downward from a central location within cavity 126. A top cover 132 encloses cavity 126, which may include batteries for an optional lighting and/or optional sound module installed in the unit 100. The top cover 132 may optionally be a solar charging panel when the optional lighting and/or an optional sound module is installed.

A cover plate 134 encloses bottom cavity 172 of tub hub 110. Rollers channels 136 are preferably cut into the cover plate 134. The roller channels 136 and cover plate 134 help retain a plurality of rollers 138 in the top hub 110. Rollers 138 are preferably made of a thermoplastic to minimize frictional forces.

The bottom hub 112 has a cavity 140 and an opposing anchor point receptacle. Bottom hub 112 has a tubular-shaped prong receptacle 142 extending upward from a central location within cavity 140. The prong receptacle 142 is shaped to receive tubular prong 128 extending from top hub 110. A bushing 170 wraps about the prong 128 and its receptacle 142. Bushing 170 is also preferably made of thermoplastic.

The bottom hub 112 also has cam channels 144. At the first end 116 of each spoke 114, a spoke cam 146 is present. The spoke 114 is preferably made of glass reinforced polyester. The flexible glass reinforced polymer spokes 114 advantageously bend under load to spill wind. The cam 146 is preferably of aluminum.

Each spoke cam 146 has a roller surface 148, as seen in FIG. 6. The spokes 114 pivot away from the housing 108 by having the roller surface 148 of each spoke cam 146 slide along each respective roller 138. Hardware 150 retains each cam 146 in its respective cam channel 144.

The actuator 156 seen in FIGS. 1-6 is a cantilever-style arrangement. In particular, the actuator 156 may include a beam 158 pivotally disposed about the support post 102, a strut 158 pivotally disposed about the support post 102 and coupled to the beam 158, a car slide 162 slideably disposed within the beam 158, and a stainless steel cable 168 coupled to the strut 160 and the housing 108. The car slide 162 includes a car slide handle 164. Moving the handle 164 gently toward the top end 104 of the support post 102 permits the umbrella 100 to go from the closed position 122 to the open position 124 (and vice versa when the handle 164 is moved in the opposite direction, i.e., toward the bottom end 106 of post 102). Such movement of the car slide 162 pivots the beam 158 and the strut 160 away from the support post 102 for tensioning the cable 168 connected to the strut 160 and the housing 108. Doing so slides the top hub 210 and bottom hub 112 closer to one another causing the spokes 114 to pivot away from the housing 108.

With this arrangement, the umbrella 100 preferably includes a first pulley 130 disposed within the top cavity 126 of the top hub 110 and a second pulley 130 disposed within the beam 158 near the junction point of the beam 158 with the top hub 110. The cable 168 runs from one end of the strut 160 through the beam 158, around the second pulley 130, into the top cavity 126 of the top hub, around the first pulley 130, through the tubular prong 128, and stops at an anchor point 152 disposed about the bottom hub 112. This arrangement advantageously creates a single-motion canopy 120 lift.

Such a single-motion canopy 120 lift may be seen with reference to FIGS. 2A-5B, which are "snapshots" in time as the umbrella 100 goes from the closed position 122 to the open position 124. FIG. 2A shows the canopy 120 disposed about the spokes 114 in its fully closed position 122. The cross-sectional view seen in FIG. 2B shows the car slide 162 seated within support post 102, the spokes 114 substantially parallel to the axis of the post 102, and the beam 158 and strut 160 substantially adjacent to the post 102. The tubular prong 128 of top hub 110 is disposed within the prong receptacle 142 of bottom hub 112. The tub hub 110 is disposed at a substantially-apart distance D from the bottom hub 112 when the umbrella 100 is in this closed position 122. One end of the spoke cam 146 is adjacent to its respective roller 138 as the actuator 156 has not yet been engaged to begin to tighten the cable 168, causing the roller surface 148 to slide along its respective roller 138 and thus pivot each spoke 114 away from housing 108.

Figure 3A:
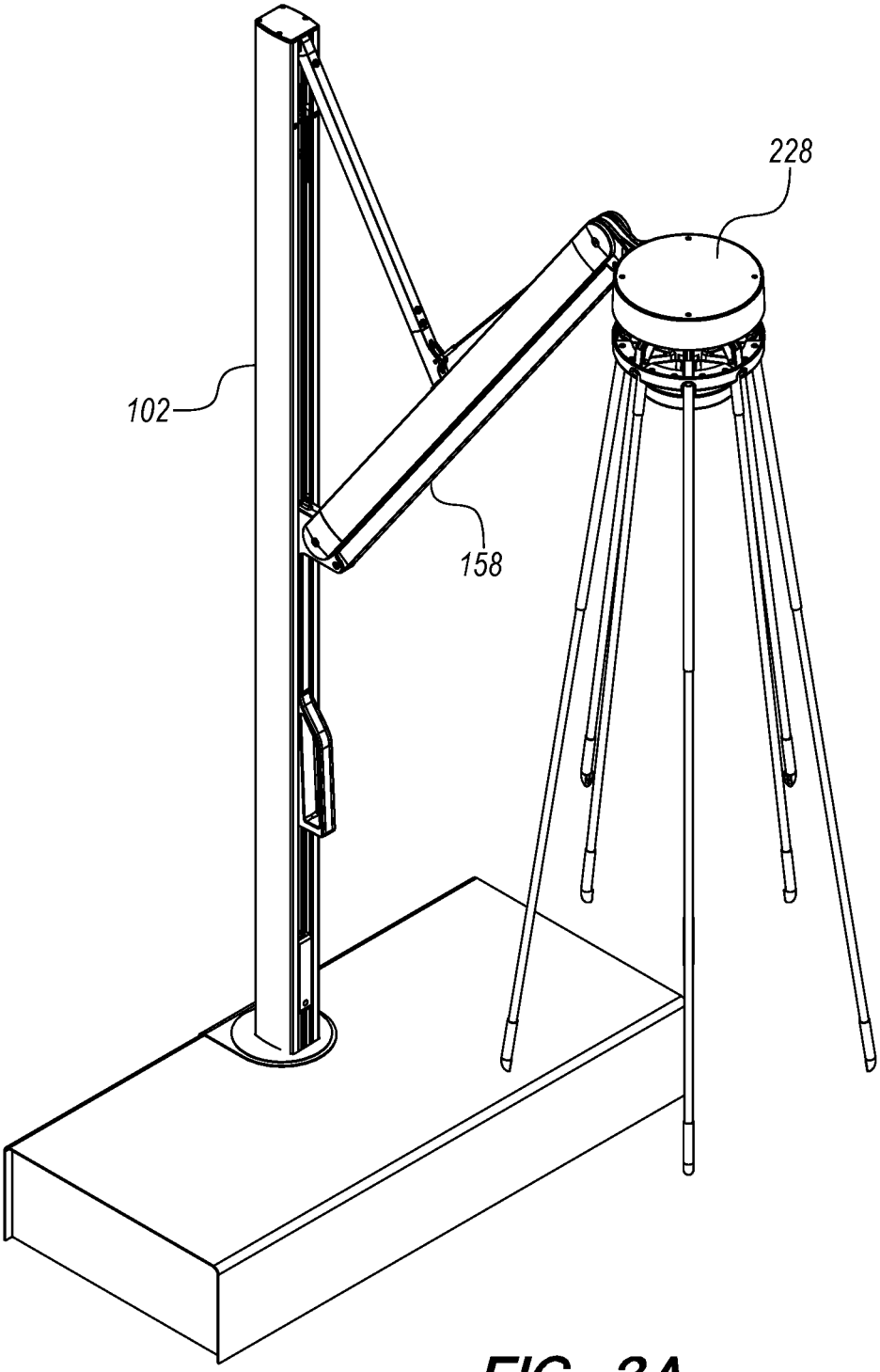
FIG. 3A is a perspective view of the umbrella seen in FIG. 1, with optional base, but without the canopy, showing the umbrella as it is transitioning from the closed position to the open position.
Figure 3B:
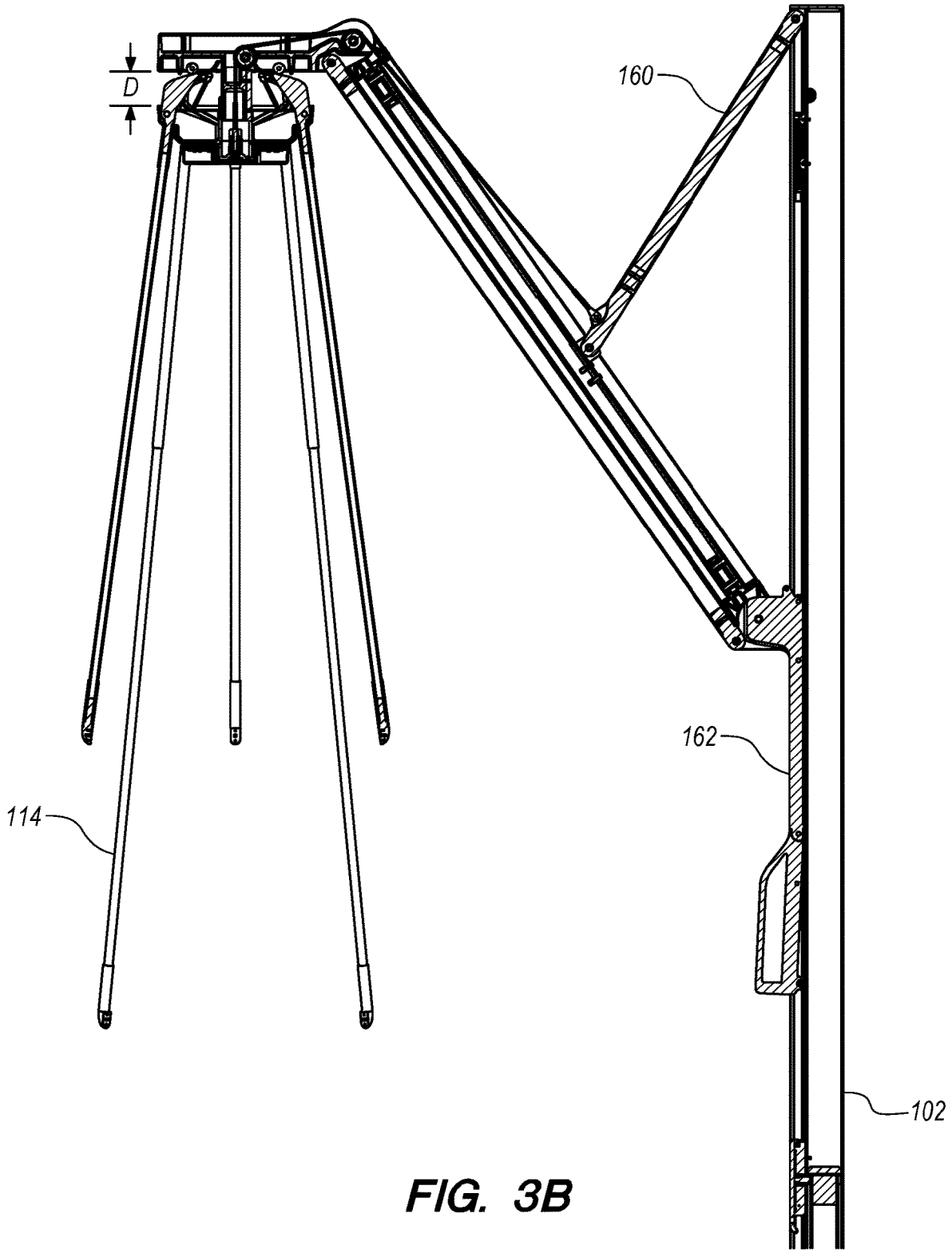
FIG. 3B is a cross-sectional view of part of the umbrella shown in FIG. 3A.

FIGS. 3A-3B illustrate the umbrella 100 as it is being opened, i.e., transitioning from a closed position 122 to an open position 124. In particular, car slide 162 may be seen being moved closer to the top end 104 of post 102. Doing so starts both the beam 158 and the strut 160 to pivot away from the post 102. This motion begins to pull on the cable 168. Since cable 168 is attached to the strut 160 at one end and the bottom of the bottom hub 112 at the other end, the bottom hub 112 moves closer to the top hub 110, as seen by the decreasing distance D in FIG. 3B. The roller surface 148 of each cam 146 accordingly begins to slide against each respective roller 138, causing each spoke 114 to begin to pivot away from the housing 108.

Figure 4A:
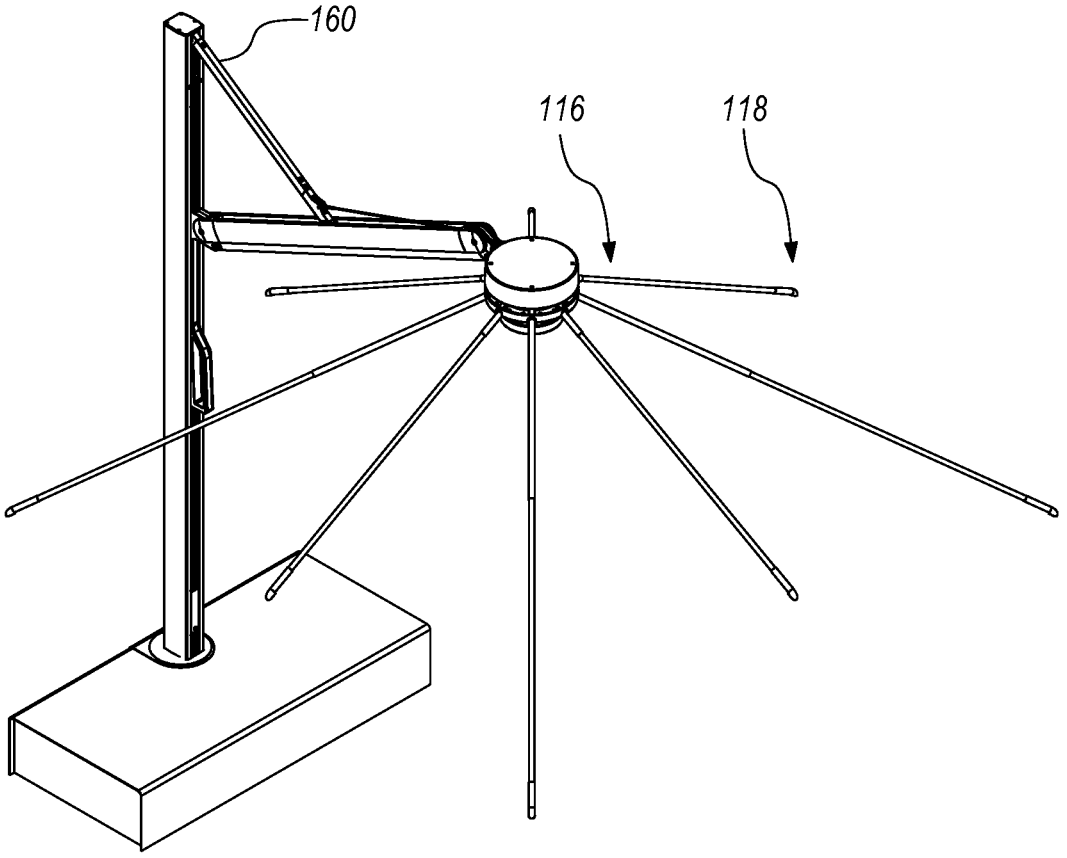
FIG. 4A is a perspective view of the umbrella seen in FIG. 1, with optional base, but without the canopy, showing the umbrella as it is transitioning further from the closed position to the open position as compared to the position of FIG. 3A.
Figure 4B:
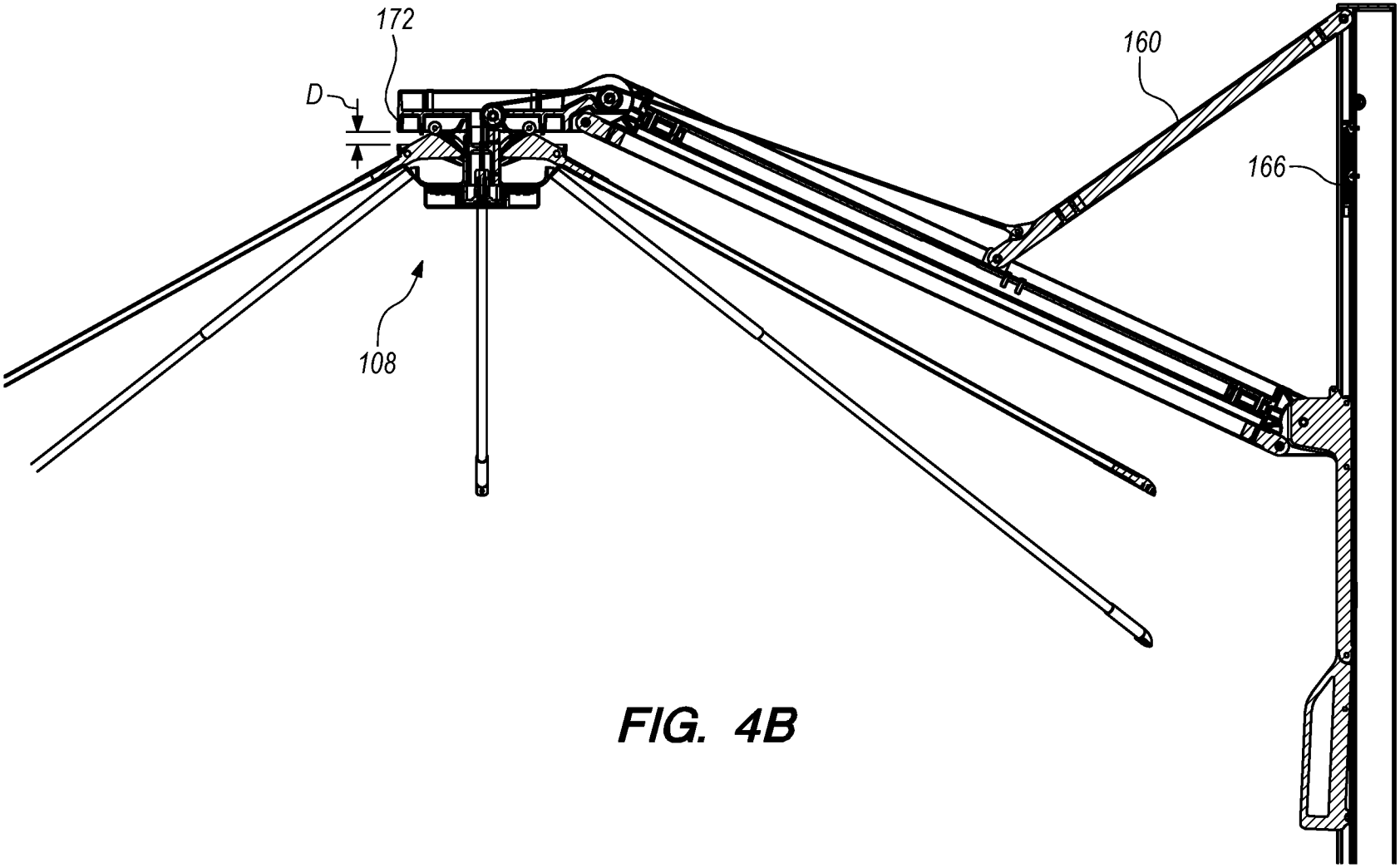
FIG. 4B is a cross-sectional view of part of the umbrella shown in FIG. 4A.

FIGS. 4A-4B illustrate the umbrella 100 as it is being opened further, i.e., transitioning further from a closed position 122 to an open position 124. In particular, car slide 162 has now moved closer to the top end 104 of post 102. Both the beam 158 and the strut 160 have continued to pivot away from the post 102, further pulling on the cable 168. Doing so pulls on the bottom hub 112 to move it closer to the top hub 110, as seen by the decreasing distance D in FIG. 4B. The roller surface 148 of each cam 146 has now slid further against each respective roller 138, causing each spoke 114 to pivot further away from the housing 108.

Figure 5A:
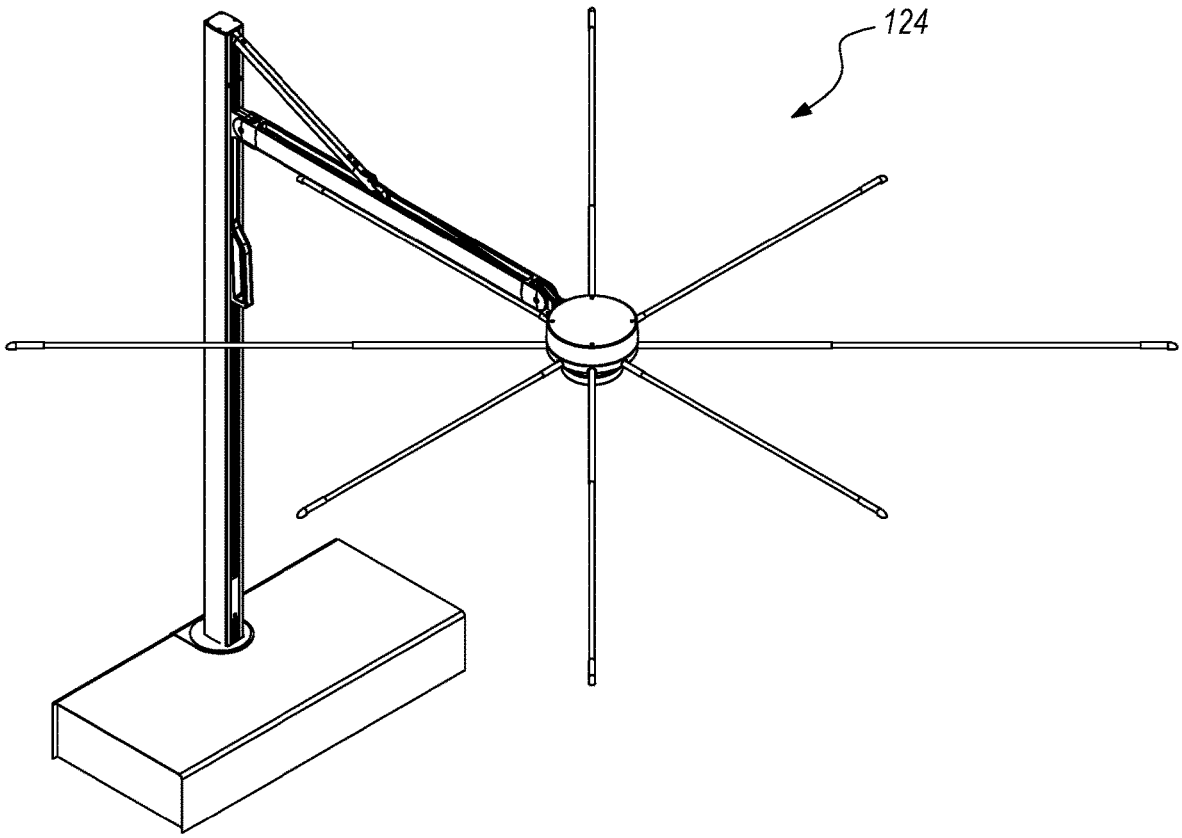
FIG. 5A is a perspective view of the umbrella seen in FIG. 1, with optional base but without the canopy, showing the umbrella fully opened in its open position.
Figure 5B:
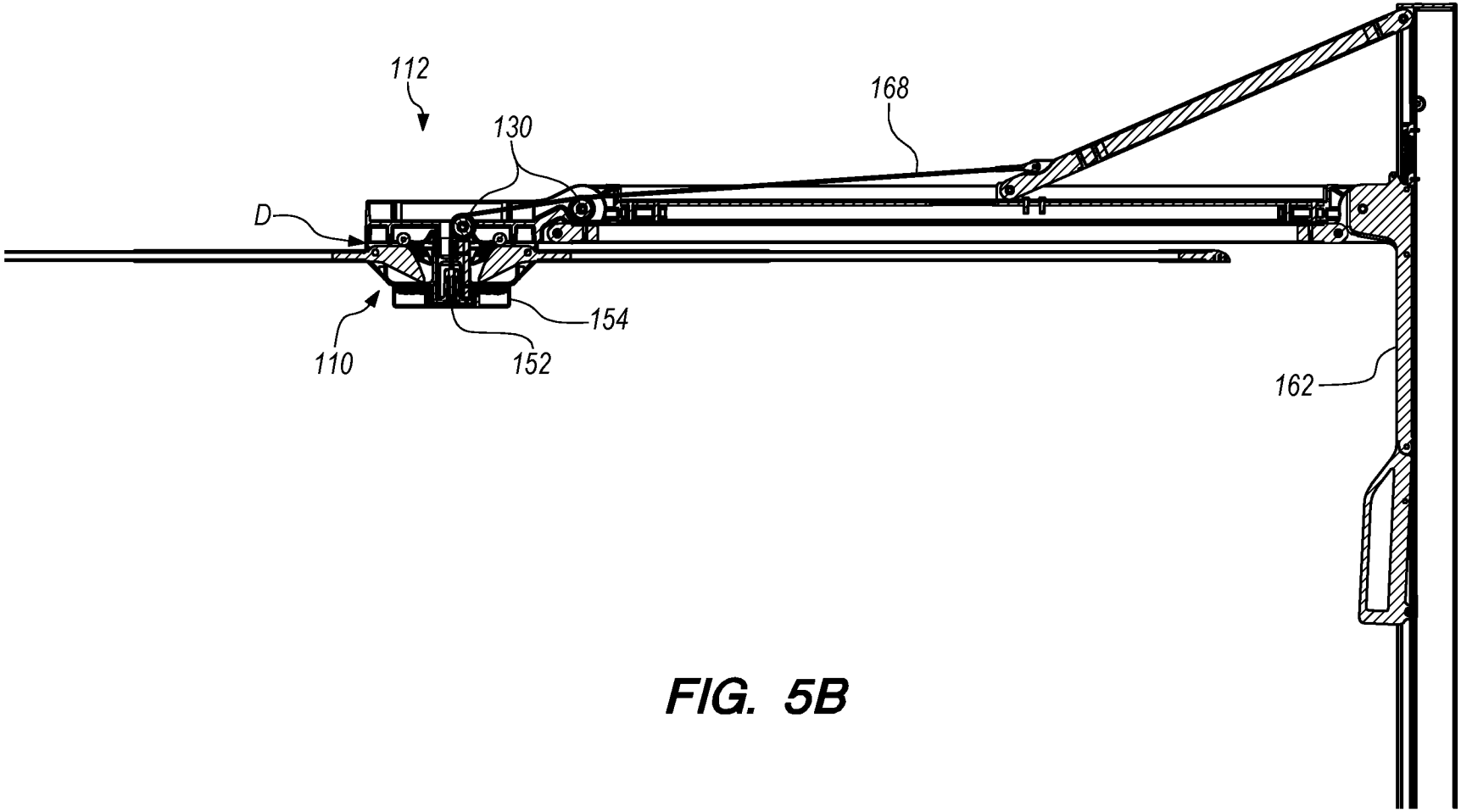
FIG. 5B is a cross-sectional view of part of the umbrella shown in FIG. 5A.

FIGS. 5A-5B illustrate the umbrella 100 in its fully opened position 124. Car slide 162 has reached the end of its travel within beam 158. To soften the force of the car slide 162 as it reaches its end of travel, a spring 166 is preferably disposed between the car slide 162 and the top end 104 of post 102. In the open position 124, both the beam 158 and the strut 160 have finished pivoting away from the post 102, finished pulling on the cable 168, and thus finished pulling on the bottom hub 112 to move it closer to the top hub 110. The top hub 110 is disposed substantially adjacent to the bottom hub 112, wherein distance D is nominal, as seen in FIG. 5B. In the open position 124, the spokes 114 may be seen as substantially orthogonal to the support post 102.

Instead of a cantilever-style arrangement as discussed above, the actuator may have a crank operated worm drive mechanism to raise and lower the canopy. FIGS. 7-11B illustrate just such an embodiment. Here, umbrella 200 comprises a support post 202 having a top end 204 and an opposing bottom end 206. A housing 208 is supported by post 202 about the top end 204. A plurality of spokes 214 are pivotally disposed about the housing 208. Each spoke 214 has a first end 216 and an opposing bottom end 288. A canopy 252 is disposed about the spokes 214.

The clamshell-style housing 208 has a top hub 210 and an opposing bottom hub 212, each of which is preferably made of die cast aluminum. Top hub 210 has a top cavity 222 and an opposing bottom cavity 236. Top hub 210 has a tubular prong 224 extending downward from a central location within cavity 222. A top cover 228 encloses cavity 222, which may include batteries for an optional lighting and/or optional sound module installed in the unit 200. The top cover 228 may optionally be a solar charging panel when the optional lighting and/or an optional sound module is installed.

A cover plate 230 encloses bottom cavity 236 of tub hub 210. Rollers channels 232 are preferably cut into the cover plate 230. The roller channels 232 and cover plate 230 help retain a plurality of rollers 234 in the top hub 210. Rollers 234 are preferably made of thermoplastic to minimize frictional forces.

The bottom hub 212 has a cavity 238 wherein a tubular-shaped prong receptacle 240 extends upward from a central location therewithin. The prong receptacle 240 is shaped to receive tubular prong 224 extending from top hub 210. A threaded receptacle 226 is disposed about the tubular prong 224.

The bottom hub 212 also has cam channels 242. At the first end 216 of each spoke 214, a spoke cam 244 is present. The spoke 244 is preferably made of glass reinforced polyester. The flexible glass reinforced polymer spokes 244 advantageously bend under load to spill wind. The cam 244 is preferably of aluminum.

Each spoke cam 244 has a roller surface 246. The spokes 214 pivot away from the housing 208 by having the roller surface 246 of each spoke cam 244 slide along each respective roller 234.

The actuator 220 seen in FIGS. 7-11B is a crank operated worm drive mechanism including crank 248 coupled to threaded rod 250 disposed within post 202. Rotation of the crank 248 causes the threaded rod 250 to screw through the threaded receptacle 226, whereby the top hub 210 and bottom hub 212 slide closer to one another causing the spokes 214 to pivot away from the housing 208 when the umbrella 200 goes from the closed position to the open position.

Figure 8A:
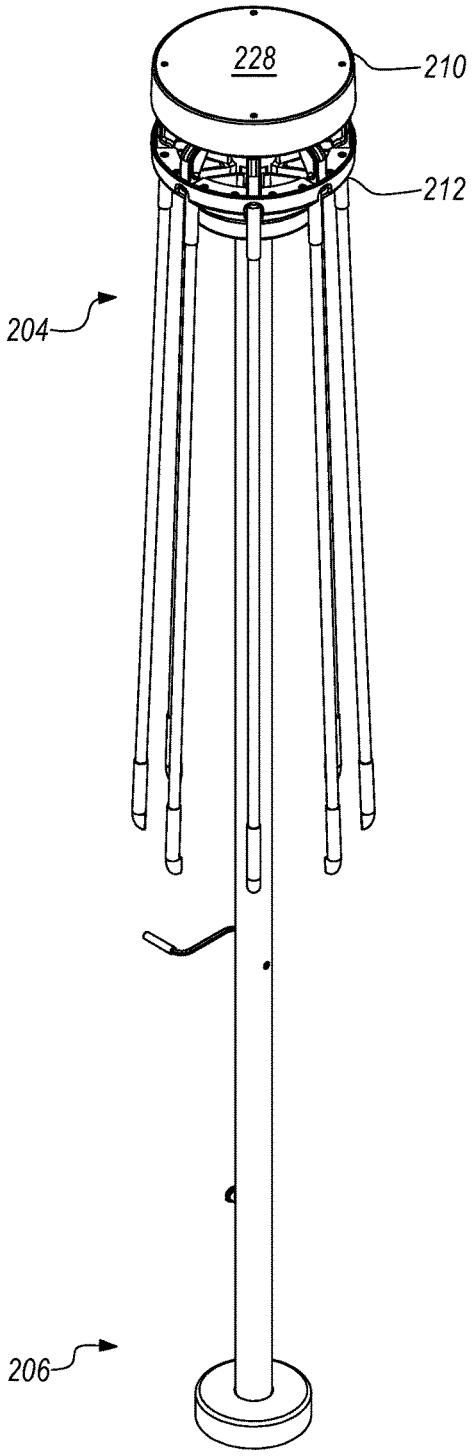
FIG. 8A is another perspective view of the umbrella seen in FIG. 7, but without the canopy, showing the umbrella in the closed position.
Figure 8B:
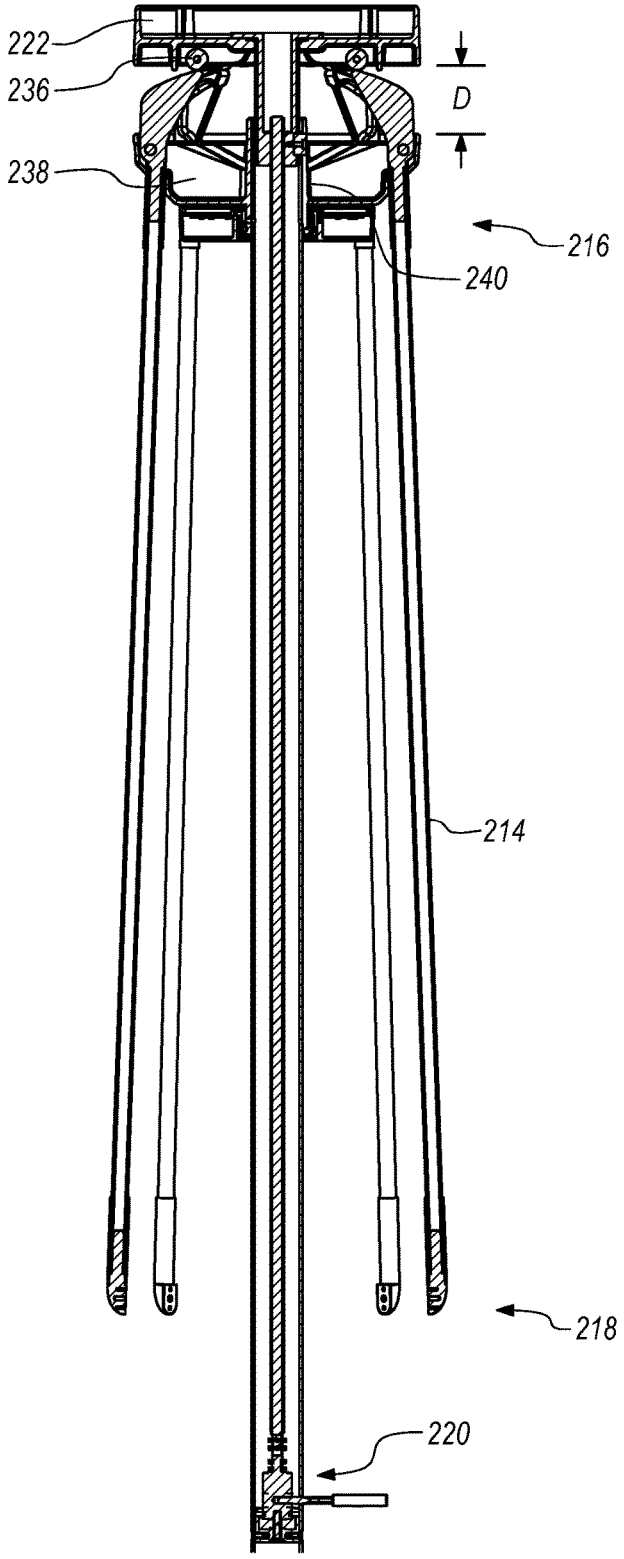
FIG. 8B is a cross-sectional, side view of part of the umbrella in FIG. 7, but showing the umbrella without its canopy and the umbrella in the closed position.

FIGS. 8A-11B illustrate "snapshots" in time as the umbrella 200 goes from the closed position to the open one. FIGS. 8A-8B shows the umbrella 200 in the fully closed position. The cross-sectional view seen in FIG. 8B shows the threaded rod 250 furthest away from the top cover 228, wherein the spokes 214 are substantially parallel to the axis of the post 202. The tubular prong 224 of top hub 210 is disposed within the prong receptacle 240 of bottom hub 212. The tub hub 210 is disposed at a substantially-apart distance D from the bottom hub 212 when the umbrella 200 is in this closed position. One end of the spoke cam 244 is adjacent to its respective roller 234 as the actuator 220 has not yet been engaged to cause the roller surface 246 to slide along its respective roller 234 and thus pivot each spoke 214 away from housing 208.

Figure 9A:
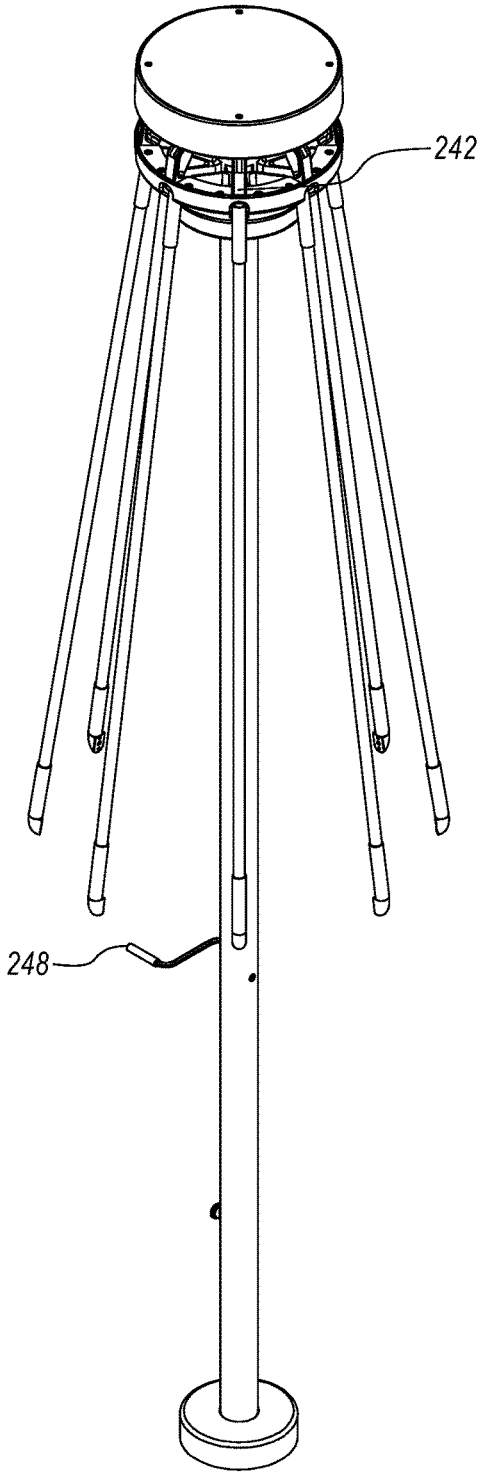
FIG. 9A is another perspective view of the umbrella seen in FIG. 7, but without the canopy, showing the umbrella as it is transitioning from the closed position to the open position.
Figure 9B:
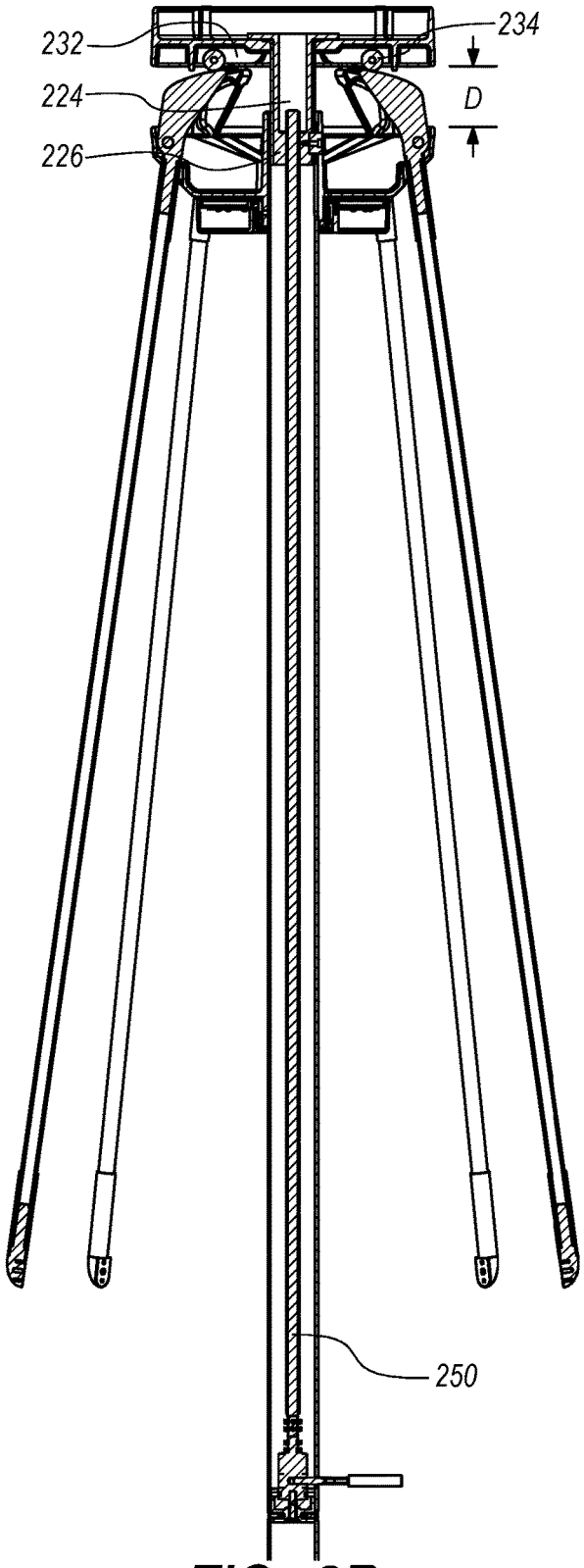
FIG. 9B is a cross-sectional, side view of part of the umbrella in FIG. 7, but showing the umbrella without its canopy and the umbrella in its transitional position seen in FIG. 9A.

FIGS. 9A-9B illustrate the umbrella 200 as it is being opened, i.e., transitioning from a closed position to an open position. In particular, the user rotates the crank 248 to screw the threaded rod 250 through the threaded receptacle 226. Doing so moves the top hub 210 closer to the bottom hub 212, as seen by the decreasing distance D in FIG. 9B. The roller surface 246 of each cam 244 accordingly begins to slide against each respective roller 234, causing each spoke 214 to begin to pivot away from the housing 208.

Figure 10A:
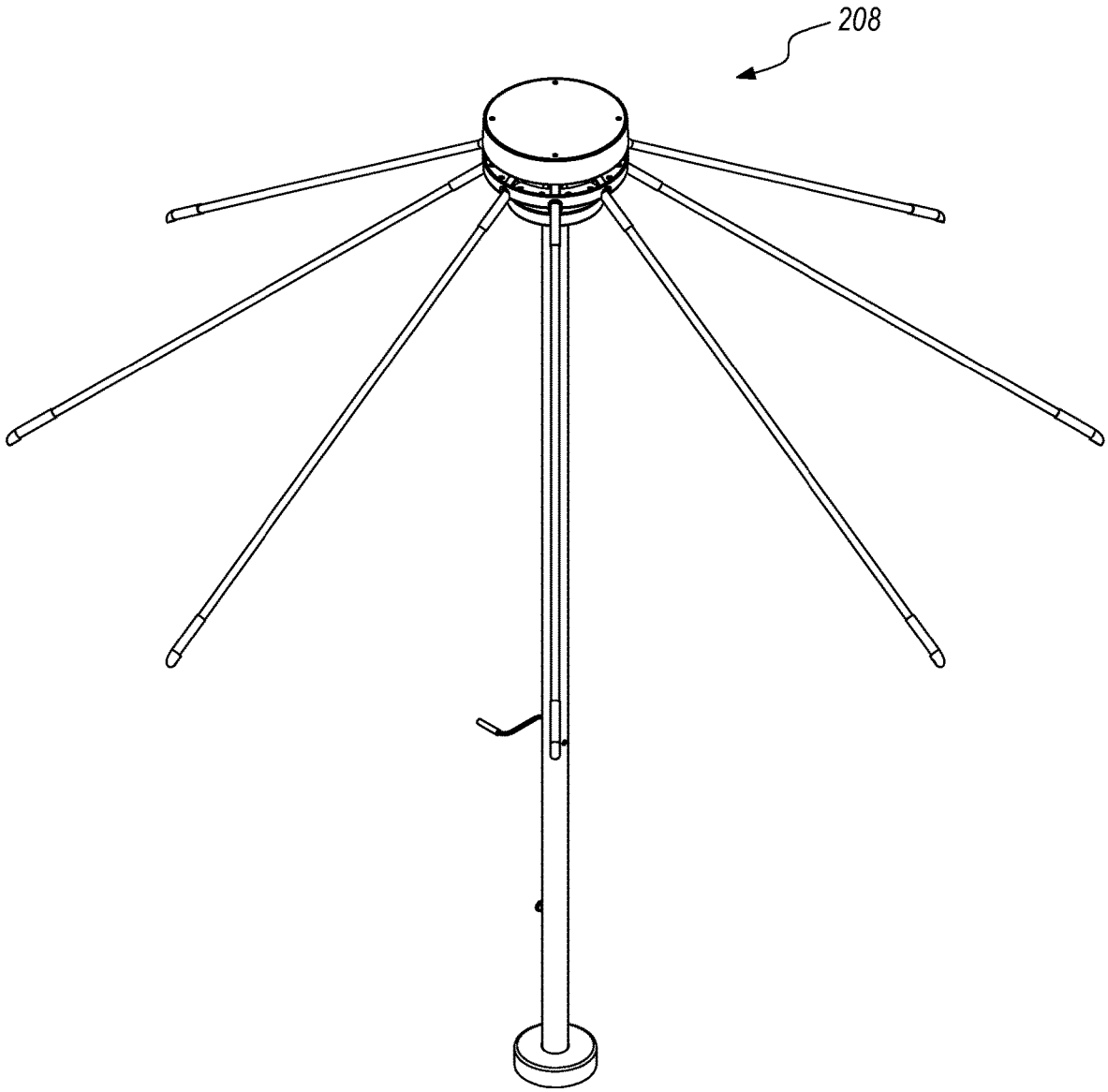
FIG. 10A is another perspective view of the umbrella seen in FIG. 7, but without the canopy, showing the umbrella as it is transitioning further from the closed position to the open position compared to the position seen in FIG. 9A.
Figure 10B:
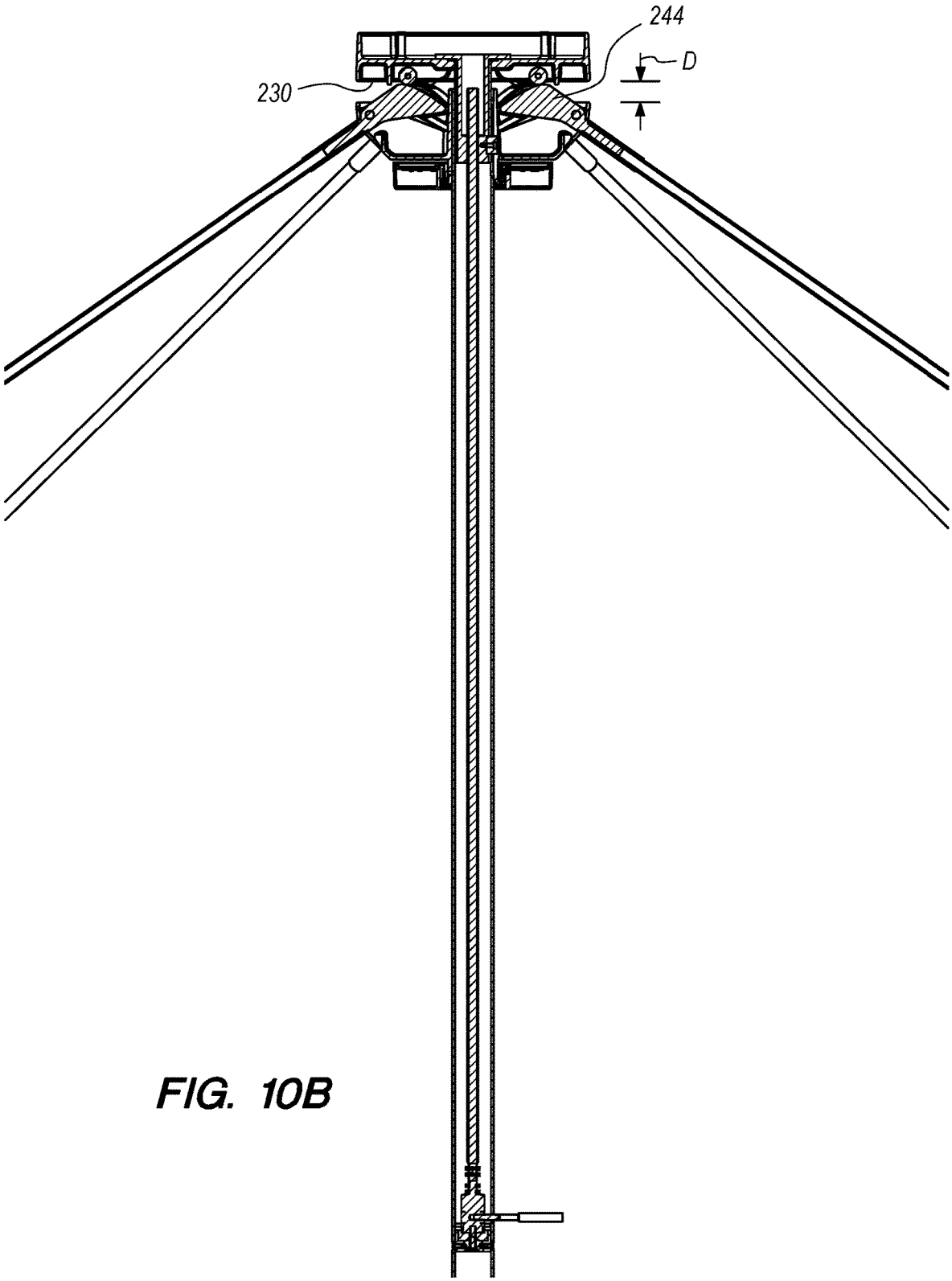
FIG. 10B is a cross-sectional, side view of part of the umbrella in FIG. 7, but showing the umbrella without its canopy and the umbrella in its transitional position seen in FIG. 10A.

FIGS. 10A-10B illustrate the umbrella 200 as it is being opened further, i.e., transitioning further from a closed position to an open one. In particular, the user continues to rotate crank 248 to screw the threaded rod 250 further through the threaded receptacle 226. Doing so moves the top hub 210 closer to the bottom hub 212, as seen by the decreasing distance D in FIG. 10B.

Figure 11A:
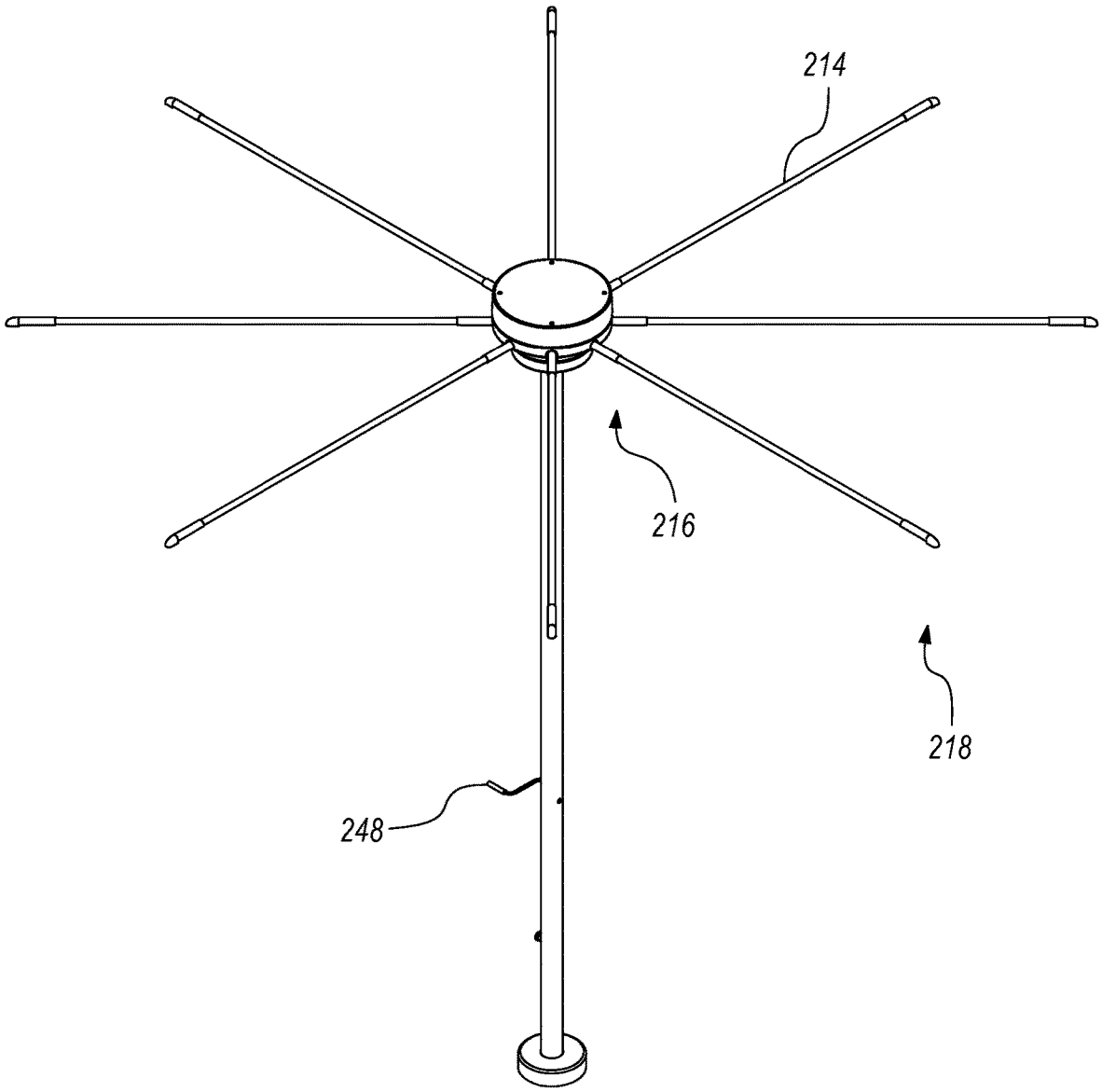
FIG. 11A is another perspective view of the umbrella seen in FIG. 7, but without the canopy, showing the umbrella fully opened in its open position.
Figure 11B:
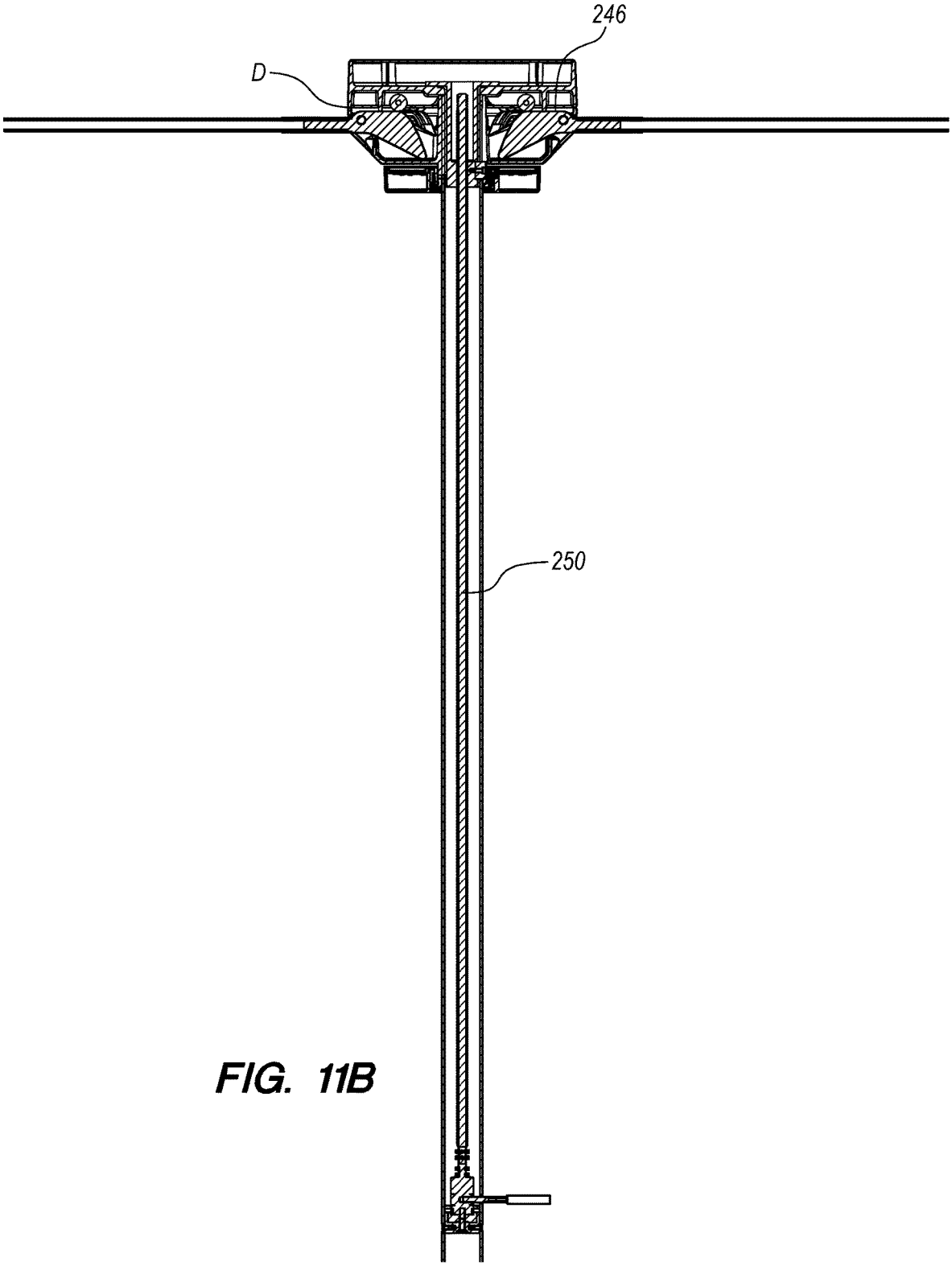
FIG. 11B is a cross-sectional, side view of part of the umbrella in FIG. 7, but showing the umbrella without its canopy and the umbrella in its fully opened position.

FIGS. 11A-11B illustrate the umbrella 200 in its fully opened position. The threaded rod 250 has reached the end of its travel within the housing 208. The top hub 210 is disposed substantially adjacent to the bottom hub 212, wherein distance D is nominal, as seen in FIG. 11B. In the open position, the spokes 214 may be seen as substantially orthogonal to the support post 202.

It should now be apparent the disclosed umbrellas 100, 200 have a simplified structure that creates a clean, elegant profile with dramatically reduced component count, increased wind resistance, and decreased number of components to change out to offer different size canopies.

While certain embodiments have been described, the embodiments have been presented by way of example only and are not intended to limit the scope of the inventions. Indeed, the novel umbrella embodiments described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. An umbrella having a closed position and an open position, the umbrella comprising:

a support post;

a housing supported by the post, wherein the housing has a top hub and an opposing bottom hub, wherein the top hub and bottom hub are slideably engageable with one another;

one or more spokes having a first end and an opposing second end, wherein the first end of each spoke is pivotally disposed between the top hub and the bottom hub;

one or more rollers retained within the top hub, wherein the one or more spokes have a spoke cam having a roller surface;

a canopy disposed about the one or more spokes; and an actuator for sliding the top hub and bottom hub together to pivot the one or more spokes away from the housing, whereby the umbrella moves from the closed position to the open position.

2. The umbrella of claim 1, wherein the top hub has a tubular prong extending downward therefrom, and wherein the bottom hub has a prong receptacle extending upward therefrom, the prong receptacle adapted to receive the tubular prong.

3. The umbrella of claim 2, wherein the tubular prong slides within the prong receptacle as the umbrella moves from the closed position to the open position.

4. The umbrella of claim 1, wherein the one or more spokes pivot away from the support post by having the roller surface of each spoke cam slide along each respective roller.

5. The umbrella of claim 1, wherein the bottom hub has one or more cam channels for respectively receiving the one or more spoke cams.

6. The umbrella of claim 1, further comprising a cover plate having one or more rollers channels for respectively receiving the one or more rollers.

7. The umbrella of claim 1, wherein the actuator includes a beam pivotally disposed about the support post, a strut pivotally disposed about the support post and coupled to the beam, a car slide slideably disposed within the beam, and a cable coupled to the strut and the housing.

8. The umbrella of claim 7, wherein the car slide moves toward the top end of the support post when the umbrella goes from the closed position to the open position, wherein movement of the car slide pivots the beam and the strut away from the support post for tensioning the cable connected to the strut and the housing, whereby the top hub and bottom hub slide closer to one another causing the one or more spokes to pivot away from the housing.

9. The umbrella of claim 8, further comprising a first pulley disposed within a top cavity of the top hub, wherein the cable runs from one end of the strut through the beam and into the top cavity of the top hub, around the first pulley, through a tubular prong, and stops at an anchor point disposed about the bottom hub.

10. An umbrella comprising:

a support post;

a housing having a top hub and an opposing bottom hub, wherein the top hub is disposed substantially apart from the bottom hub when the umbrella is in a closed position, and wherein the top hub is disposed substantially adjacent to the bottom hub when the umbrella is in an open position;

one or more spokes having a first end and an opposing bottom end, wherein the first end of each spoke is pivotally disposed between the top hub and the bottom hub, wherein the one or more spokes are substantially parallel to the support post when the umbrella is in the closed position, and wherein the one or more spokes are substantially orthogonal to the support post when the umbrella is in the open position;

one or more rollers retained within the top hub, wherein the one or more spokes have a spoke cam having a roller surface;

a canopy disposed about the one or more spokes; and an actuator for moving the top hub and bottom hub toward one another to cause the one or more spokes to pivot away from the housing to move the umbrella from the closed position to the open position, wherein the actuator includes a beam pivotally disposed about the support post, a strut pivotally disposed about the support post and coupled to the beam, a car slide slideably disposed within the beam, and a cable coupled to the strut and the housing.

11. The umbrella of claim 10, wherein the car slide moves toward the top end of the support post when the umbrella goes from the closed position to the open position, wherein movement of the car slide pivots the beam and the strut away from the support post for tensioning the cable connected to the strut and the housing, and wherein the one or more spokes pivot away from the housing by having the roller surface of each spoke cam slide along each respective roller.

* * * * *